US007614904B2

(12) United States Patent
Hiramatsu

(10) Patent No.: US 7,614,904 B2
(45) Date of Patent: Nov. 10, 2009

(54) CONNECTOR

(75) Inventor: Hiroyuki Hiramatsu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/143,993

(22) Filed: Jun. 23, 2008

(65) Prior Publication Data

US 2008/0318458 A1 Dec. 25, 2008

(30) Foreign Application Priority Data

Jun. 25, 2007 (JP) ..... 2007-166605

(51) Int. Cl.
*H01R 3/00* (2006.01)

(52) U.S. Cl. ..... 439/489; 439/352

(58) Field of Classification Search ..... 439/352, 439/353, 354, 357, 358, 488, 489
See application file for complete search history.

(56) References Cited

U.S. PATENT DOCUMENTS

| | | | | |
|---|---|---|---|---|
| 5,061,197 | A | 10/1991 | Kuzuno et al. | |
| 5,217,390 | A * | 6/1993 | Nozaki et al. | 439/489 |
| 6,688,907 | B2 * | 2/2004 | Yamaoka et al. | 439/489 |
| 6,692,288 | B2 * | 2/2004 | Nimura | 439/352 |
| 7,252,530 | B2 * | 8/2007 | Shamoto | 439/352 |
| 2004/0102075 | A1 | 5/2004 | Nakamura | |
| 2007/0059969 | A1 | 3/2007 | Shamoto | |
| 2007/0105420 | A1 | 5/2007 | Shigeta et al. | |
| 2008/0220639 | A1 * | 9/2008 | Ohara | 439/188 |
| 2008/0318458 | A1 * | 12/2008 | Hiramatsu | 439/246 |
| 2009/0035980 | A1 * | 2/2009 | Nakamura | 439/352 |
| 2009/0111312 | A1 * | 4/2009 | Nakata et al. | 439/357 |

FOREIGN PATENT DOCUMENTS

JP 2006-024435 1/2006

* cited by examiner

*Primary Examiner*—James Harvey
(74) *Attorney, Agent, or Firm*—Gerald E. Hespos; Anthony J. Casella

(57) ABSTRACT

A connector includes female and male housings (10, 40) that are connectable along a connecting direction (CD). A connection detector (30) is mounted on the female housing (10) for movement along the connecting direction (CD) between standby and detection positions. The connection detector (30) does not contact receiving portions (48) of the male housing (40) when the connection detector (30) is at the standby position. However, pressing portions (32) of the connection detector (30) press the receiving portions (48) when the connection detector (CD) is at the detection position to prevent relative movements of the connection detector (30) and the male connector housing (40). Thus, connection resistance between the receiving portions (48) and the pressing portions (32) is not produced when the connection detector (30) is at the standby position.

4 Claims, 14 Drawing Sheets

CONNECTOR

BACKGROUND OF THE INVENTION

1. Field of the Invention

The invention relates to a connector.

2. Description of the Related Art

Japanese Unexamined Patent Publication No. 2006-24435 discloses a connector with male and female housings that can be connected to one another along a connecting direction. A rib projects from the outer peripheral surface of the female housing and is pressed against the inner peripheral surface of a receptacle of the male connector housing to prevent backlash between the housings in directions intersecting the connecting direction and consequently to prevent fine sliding abrasion between terminal fittings mounted in the housings.

Sliding resistance is produced between the rib and the receptacle over the entire stroke from the start to the end of a connecting operation. Thus, a large connection resistance exists and an improvement has been desired.

The present invention was developed in view of the above situation and an object thereof is to reduce connection resistance.

SUMMARY OF THE INVENTION

The invention relates to a connector with first and second housings that are connectable with each other. A connection detector is assembled with a first housing to prevent relative movements in directions intersecting a connecting direction of the two housings and to permit movements between a standby position and a detection position in a direction substantially parallel to the connecting direction of the housings. A restriction is provided in the second housing of the connector housings. The connection detector is arranged to avoid contact with the restriction when the connection detector is at the standby position. The connection detector has at least one pressing portion that presses the restriction when the connection detector is at the detection position to prevent relative movements of the connection detector with respect to the second housing in directions intersecting the connecting direction.

The pressing portion does not press the restriction when the connection detector is at the standby position and hence the pressing portion does not produce connection resistance. Thus, the two housings can be connected smoothly. However, the pressing portion of the connection detector presses the restriction when the connection detector is at the detection position to prevent backlash between the two housings.

The restriction preferably is inclined with respect to the moving direction of the connection detector. Thus, pressing forces of the pressing portion against the receiving portion increase as the connection detector approaches the detection position.

The second housing preferably is formed with at least one guide rib that is substantially parallel to the connecting direction. The guide rib is disposed for sliding contact with the first housing.

The restriction is defined on a surface of the guide rib different from a sliding contact surface with the first housing. Thus, the shape of the second housing can be simplified as compared with the case where a special restriction is formed separately from the guide rib.

The guide rib preferably is widened gradually in a moving direction of the connection detector from the standby position towards the detection position so that the restriction is inclined with respect to the moving direction of the connection detector. Thus, a force of the pressing portion pressing the restriction increases to strengthen a biting action as the connection detector approaches the detection position. Thus, movements of the connection detector relative to the second housing are prevented more reliably.

The guide rib preferably is formed with at least one eave continuous with the restriction an aligned at an angle to the restriction.

A mount space preferably is defined between the eave and the restriction. The mount space receives the connection detector and prevents loose movements thereof.

The guide rib on the second housing preferably is arranged adjacent to a lock for locking the two housings in a properly connected condition.

The guide rib preferably slides in contact with an inner peripheral surface of a tubular fitting of the first housing in the process of connecting the two housings to prevent inclinations of the two housings.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
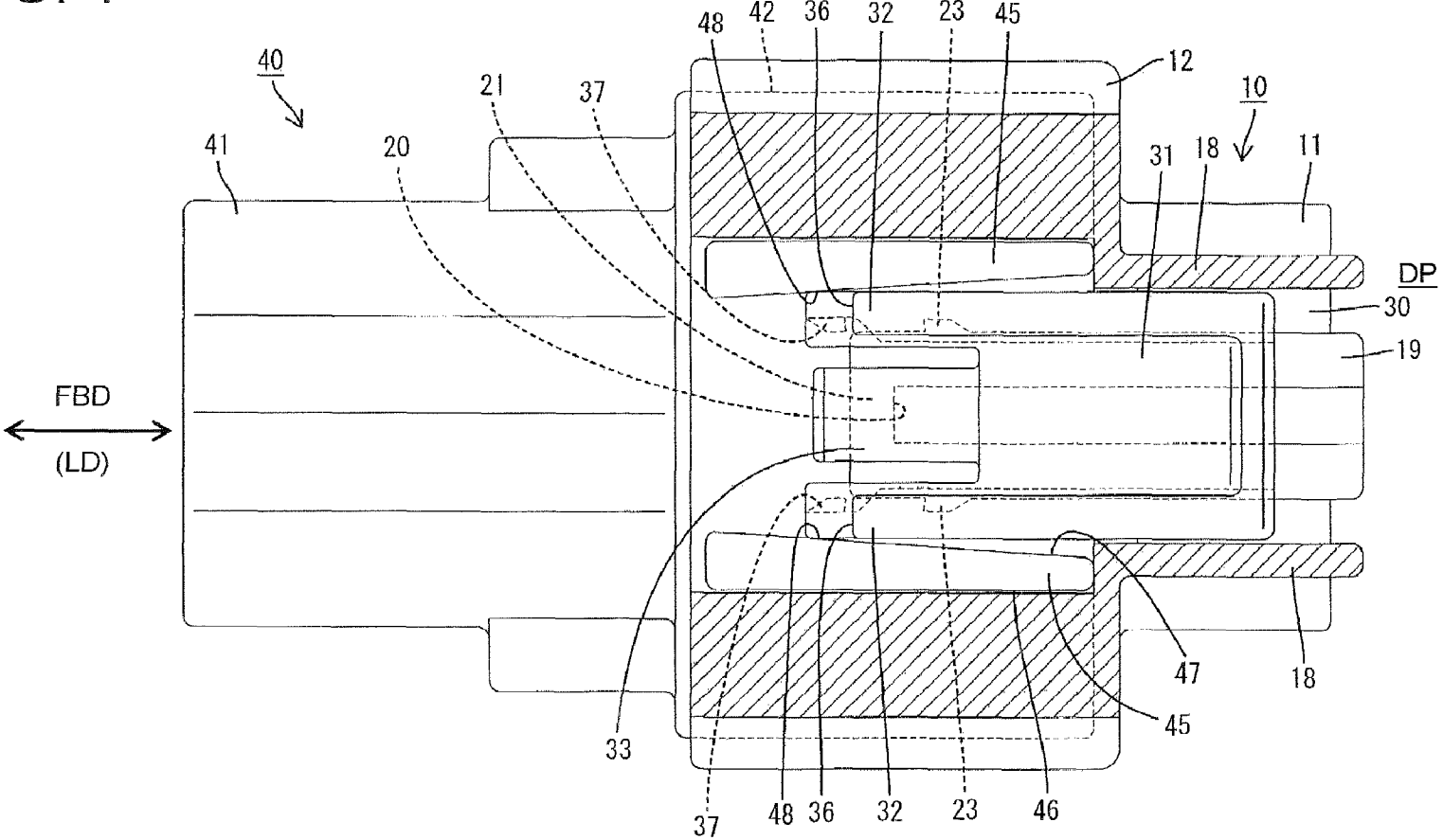
FIG. 1 is a plan view, partly in section, of a connector according to a first embodiment and showing a state where two housings are connected properly and a connection detector is at a detection position.

A connector in accordance with a first embodiment of the invention is illustrated FIGS. 1 to 13 and includes a female housing 10, a connection detector 30 assembled with the female housing 10 and a male housing 40.

The female connector housing 10 is formed unitarily e.g. of synthetic resin and includes a substantially block-shaped terminal accommodating portion 11 and a substantially tubular fitting 12 that surrounds the terminal accommodating portion 11. Female terminal fittings 13 are inserted into the terminal accommodating portion 11 from behind and are retained respectively by locking lances 14. The tubular fitting 12 is supported on the outer peripheral surface of the terminal accommodating portion 11 and projects forward from a position near the rear end of the terminal accommodating portion 11. A receptacle 42 of the male housing 40 is insertable into a substantially tubular connection space between the terminal accommodating portion 11 and the tubular fitting 12. A cutout 16 is formed in the top wall of the tubular fitting 12 and a front stop 17 is defined between the cutout 16 and the front end of the tubular fitting 12. Left and right holding ribs 18 are formed on the upper surface of the terminal accommodating portion 11 and extend in substantially forward and backward direction FBD, which is parallel to a connecting direction CD of the housings 10, 40 and to a moving direction of the connection detector 30. The holding ribs 18 are formed in a rear portion of the terminal accommodating portion 11 with respect to forward and backward direction FBD.

A lock arm 19 is formed on the upper surface of the terminal accommodating portion 11 at a position aligned with the cutout 16. The lock arm 19 is a substantially horizontal plate that is long in the forward and backward direction FBD. A locking hole 20 penetrates a front part of the lock arm 19 vertically and in a direction substantially normal to the connecting direction CD. Thus, a locking portion 21 is formed near the front end of the lock arm 19 and forward of the locking hole 20. The lock arm 19 is formed with one or more Legs 22 extend substantially perpendicularly down a longitudinal intermediate position of the lock arm 19 and support and support the lock arm 19 on the upper surface of the terminal accommodating portion 11. Retaining projections 23 are formed on the opposite left and right edges of the lock arm 19. In a free state free from resilient deformation, the lock arm 19 is in a locking posture substantially in parallel with the upper surface of the terminal accommodating portion 11 and substantially parallel to the connecting direction CD of the two housings 10, 40. However, the lock arm 19 is resiliently displaceable like a seesaw about the legs 22 and assumes an unlocking posture by displacing the front end up.

The connection detector 30 is made unitarily e.g. of synthetic resin and includes a substantially rectangular plate-shaped main portion 31 that is long in forward and backward direction FBD. Two pressing portions 32 project forward from substantially opposite left and right sides of the front end of the main portion 31 and a substantially rectangular plate-shaped resilient locking piece 33 is cantilevered forward from the front end edge of the main portion 31 at a position between the pressing portions 32. Left and right connection ribs 34 project down from opposite sides of the bottom surface of the connection detector 30 and extend from the rear end of the main portion 31 to the front ends of the pressing portions 32. Each connection rib 34 has a substantially L-shaped cross section. Left and right guide grooves 35 are formed on the inwardly facing sides of the connection ribs 34 and extend continuously along substantially the entire length of the connection detector 30. The main portion 31 and the pressing portions 32 are thick and have a sufficiently high rigidity to be difficult to deform resiliently. Step-shaped contacts 36 are formed on the upper surfaces of the pressing portions 32 at positions behind the front ends of the pressing portions 32. Locking claws 37 project in near the front ends of the pressing portions 32. The lower surface of the resilient locking piece 33 is substantially continuous and flush with the lower surface of the main portion 31. Front parts of the resilient locking piece 33 are resiliently deformable up and down in a direction intersecting the connecting direction. A locking projection 38 projects down near the front end of the resilient locking piece 33.

The connection detector 30 is assembled with the lock arm 19 by engaging the guide grooves 35 with the opposite left and right edges of the lock arm 19 and by fitting a rear part of the main portion 31 between the holding ribs 18. Thus, the lock arm 19 and the connection detector 30 can incline together like a seesaw. Further, the engagement of the guide grooves 35 with the side edges of the lock arm 19 prevents vertical or transverse backlash movements of the connection detector 30 relative to the lock arm 19 in directions intersecting the connecting direction CD of the two housings 10, 40. The disposition of connection detector 30 between the holding ribs 18 also prevents lateral movement relative to the female connector housing 10.

Figure 13:
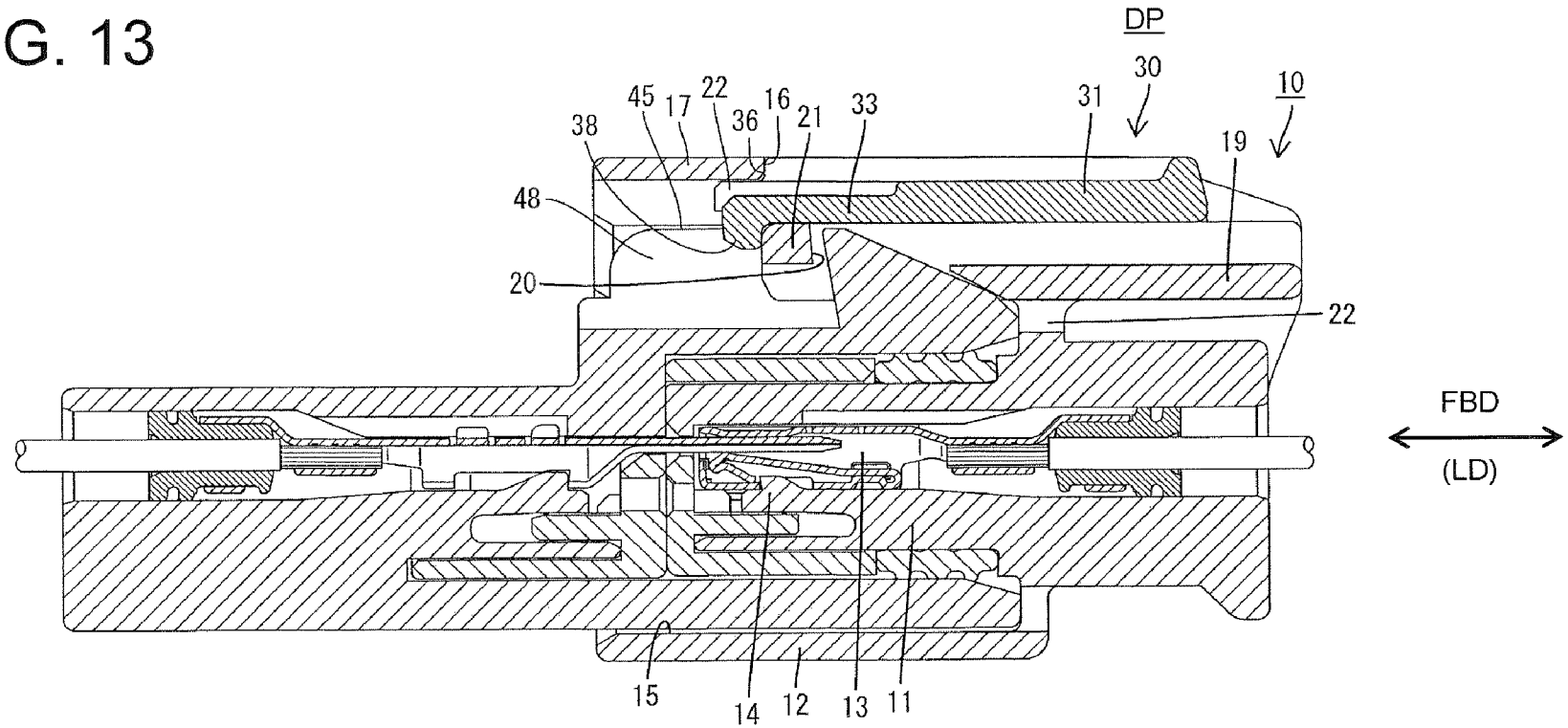
FIG. 13 is a longitudinal section showing the state where the two connector housings are properly connected and the connection detecting member is at the detection position.

The assembled connection detector 30 is movable relative to the female housing 10 in forward and backward direction FBD and parallel to connecting and separating directions CD of the two housings 10, 40 between a standby position SP (see FIGS. 2 and 10) and a detection position DP (see FIGS. 1 and 13). At the standby position SP, the locking claws 37 engage the retaining projections 23 from the front to prevent a backward detachment of the connection detector 30 and the locking projection 38 engages the locking portion 21 from behind to prevent a forward movement of the connection detector 30 towards the detection position DP. As a result, that the connection detector 30 is held at the standby position SP. On the other hand, at the detection position DP, the contacts 36 engage the front-stop 17 to prevent a forward movement of the connection detector 30 and the locking projection 38 engages the locking portion 21 from the front to prevent a backward of the connection detector 30 toward the standby position SP. The engagement of the guide grooves 35 with the side edges of the lock arm 19 and the holding of the main portion 31 between the holding ribs 18 prevents the connection detector 30 from moving up, down, left or right relative to the lock arm 19 while moving between the standby position SP and the detection position DP.

The male housing 40 is made unitarily e.g. of synthetic resin to include a substantially block shaped terminal holding portion 41 and a receptacle 42 that projects forward from the terminal holding portion 41. Male terminal fittings 43 are inserted into the terminal holding portion 41 and retained by locking lances 44. Tabs 43a at the leading ends of the male terminal fittings 43 project from the front end surface of the terminal holding portion 41 and are surrounded by the receptacle 42. A lock 44 projects up from a lateral center position on the upper surface of the top wall of the receptacle 42.

Similarly, two guide ribs 45 project from the upper surface of the top wall of the receptacle 42 and extend in substantially forward and backward directions FBD. The guide ribs 45 are arranged opposite left and right sides of the lock 44, and slide in contact with the inner peripheral surface of the tubular fitting 12 in the process of connecting the two housings 10, 40 to prevent inclinations of the housings 10, 40. As a result, the connecting operation is performed smoothly. Receiving surfaces 47 face inwardly on the guide ribs 45 and are inclined with respect to the connecting direction CD of the two housings 10, 40. Specifically, the guide ribs 45 gradually widen in a moving direction of the connection detector 30 from the standby position SP towards the detection position DP. The left and right receiving surfaces 47 are slanted so that a spacing therebetween is narrowed gradually towards the rear end of the male connector housing 40. Receiving portions 48 are defined at rear end areas of the receiving surfaces 47 for receiving a pressing force from the connection detector 30. A maximum spacing between the front ends of the left and right receiving surfaces 47 exceeds a distance between the outer surfaces of the pressing portions 32 of the connection detector 30, and a minimum spacing between the receiving portions 48 at the rear of the two receiving surfaces 47 is less than the distance between the outer surfaces of the pressing portions 32.

The connection detector 30 is positioned at the standby position SP prior to connecting the two housings 10, 40. The two housings 10, 40 then are brought closer to insert the receptacle 42 into the connection space 15. In the connection process, the front end of the lock arm 19 contacts the lock 44 and displaces resiliently up. The connection detector 30 inclines together with the lock arm 19. The locking projection 38 is in contact with the locking portion 21 in a partly connected state of the two housings 10, 40. Thus, the connection detector 30 cannot move to the detection position DP.

Figure 12:
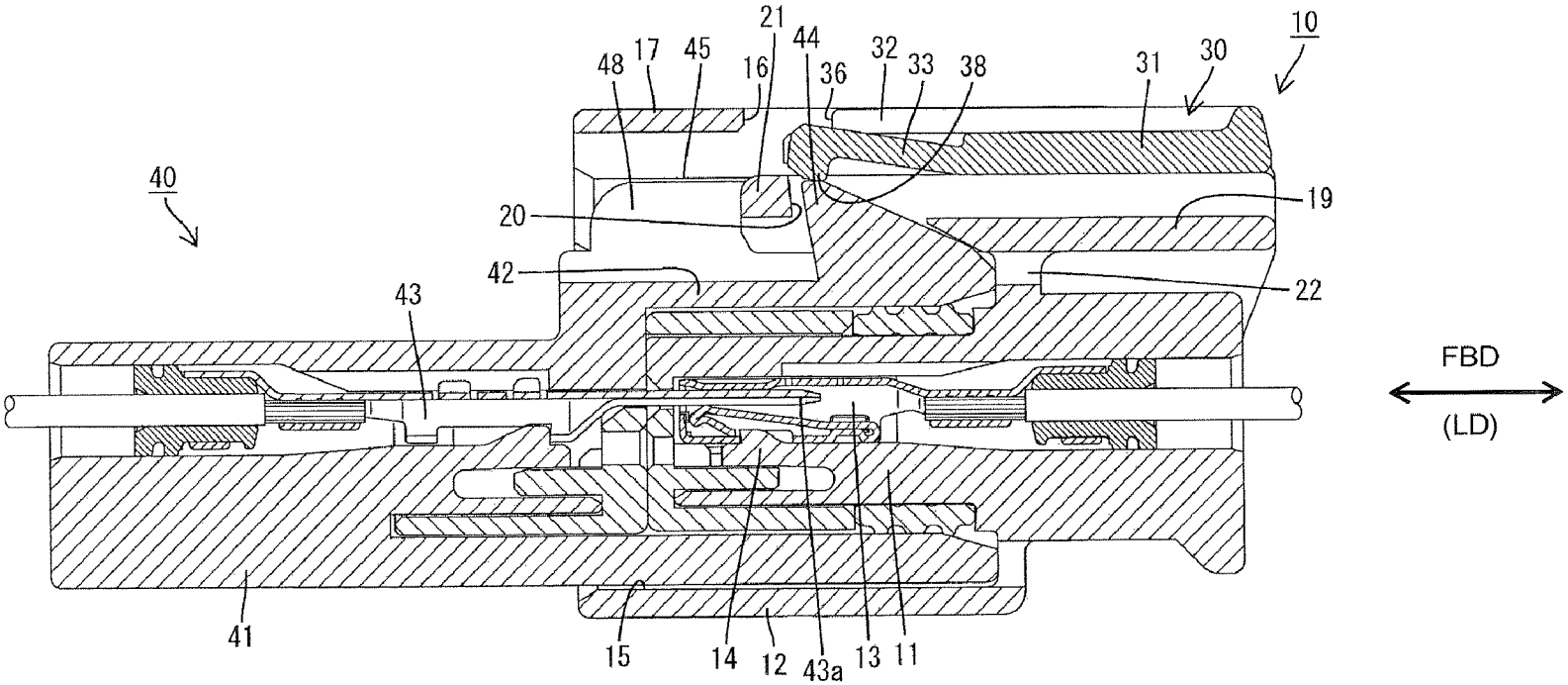
FIG. 12 is a longitudinal section showing the state where the two housings are properly connected and the connection detector is at the standby.

The locking portion 21 passes the lock 44 when the two housings 10, 40 are connected properly. Thus, the lock arm 19 restores resiliently to the locking posture and the lock 44 engages in the locking hole 20. The main portion 31 and the pressing portions 32 of the connection detector 30 return with the lock arm 19 to their horizontal postures together. However, the resilient locking piece 33 is deformed resiliently up relative to the main portion 31 and the pressing portions 32 because the locking projection 38 is still on the upper end of the lock 44. In this way, as shown in FIG. 12, the lock projection 38 is disengaged from the locking portion 21. Therefore the connection detector 30 is permitted to move towards the detection position DP.

Figure 2:
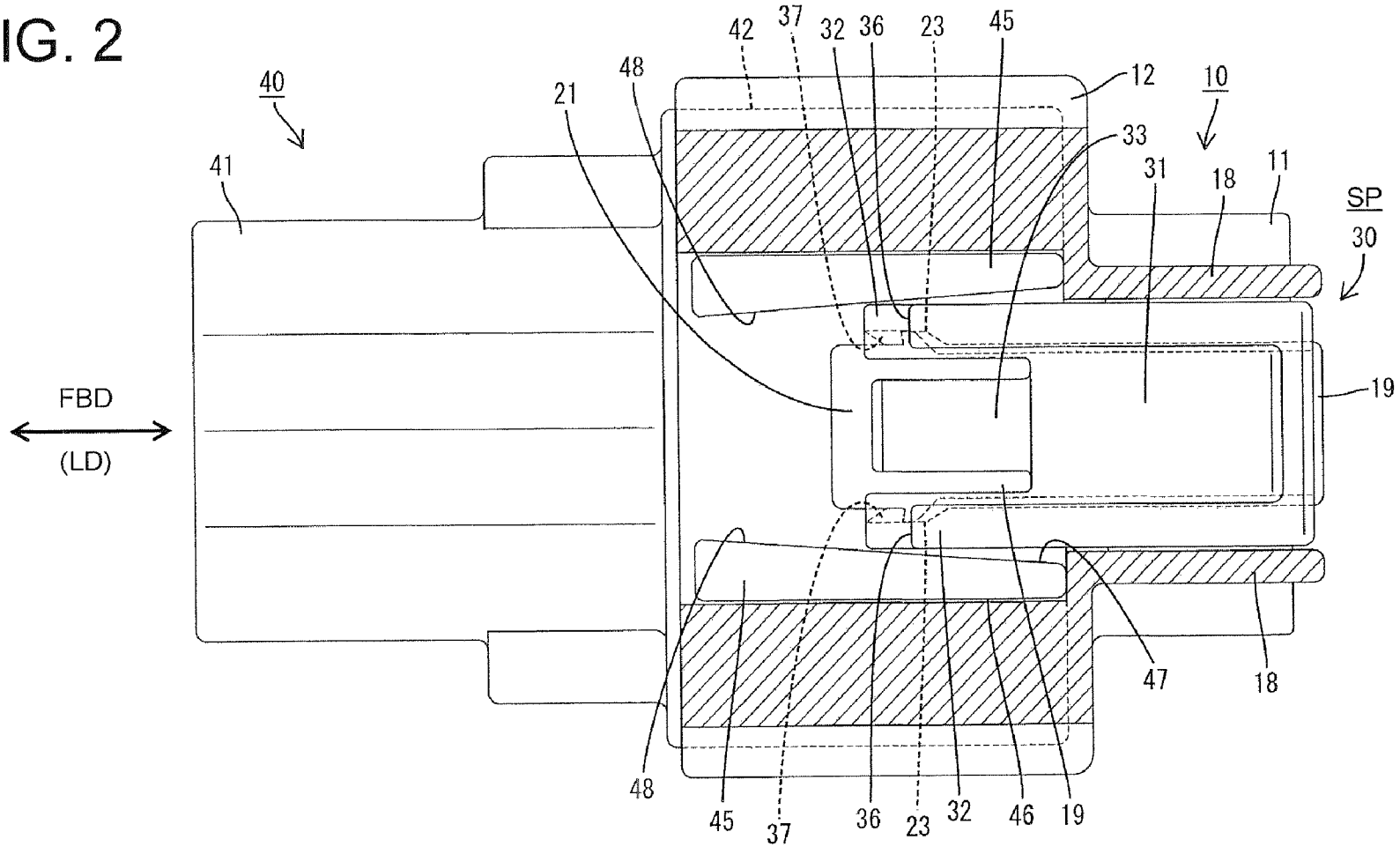
FIG. 2 is a plan view, partly in section, showing a state where the two housings are connected properly and the connection detector is at a standby position.
Figure 3:
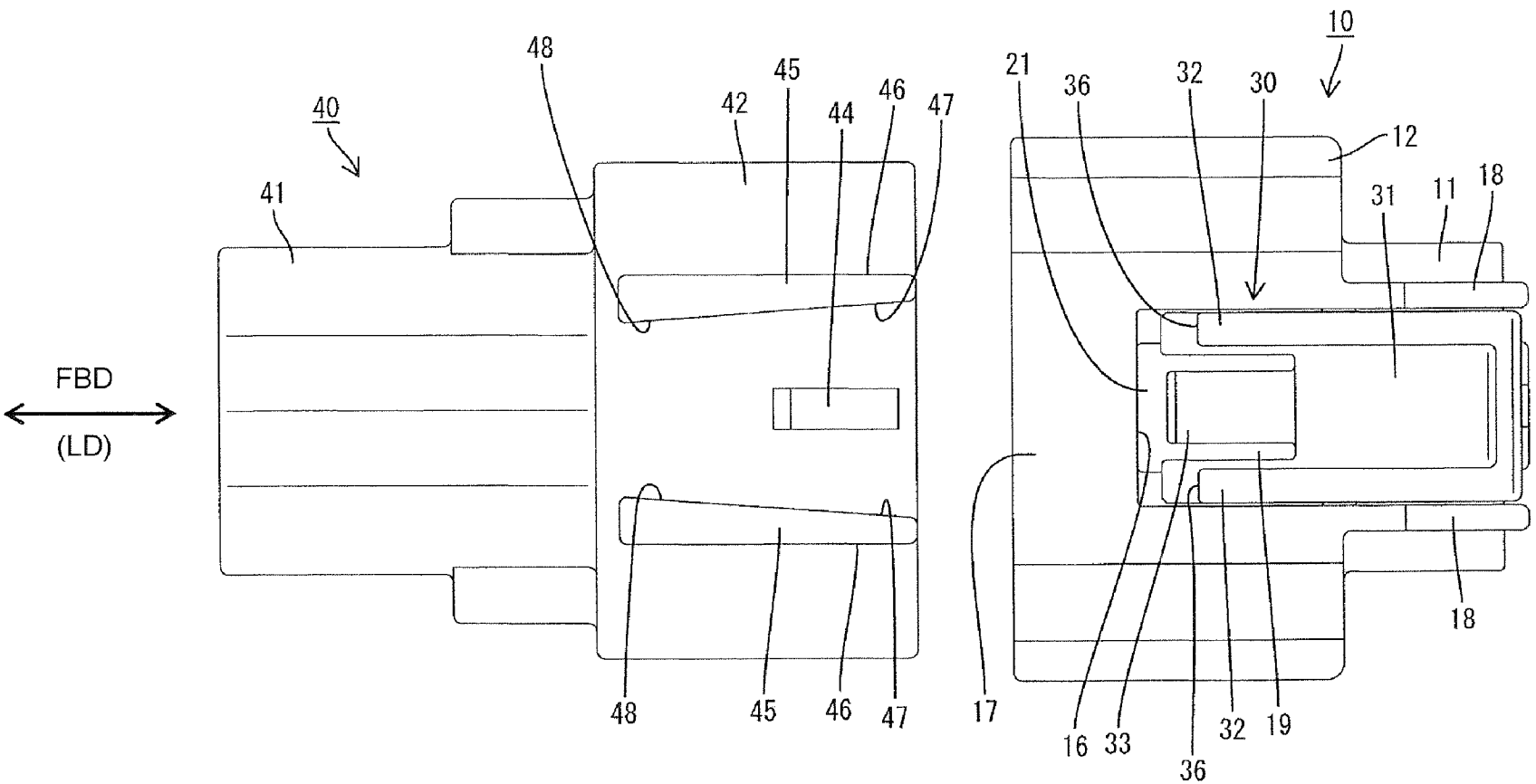
FIG. 3 is a plan view showing a state where the female housing and the male housing are separated.
Figure 4:
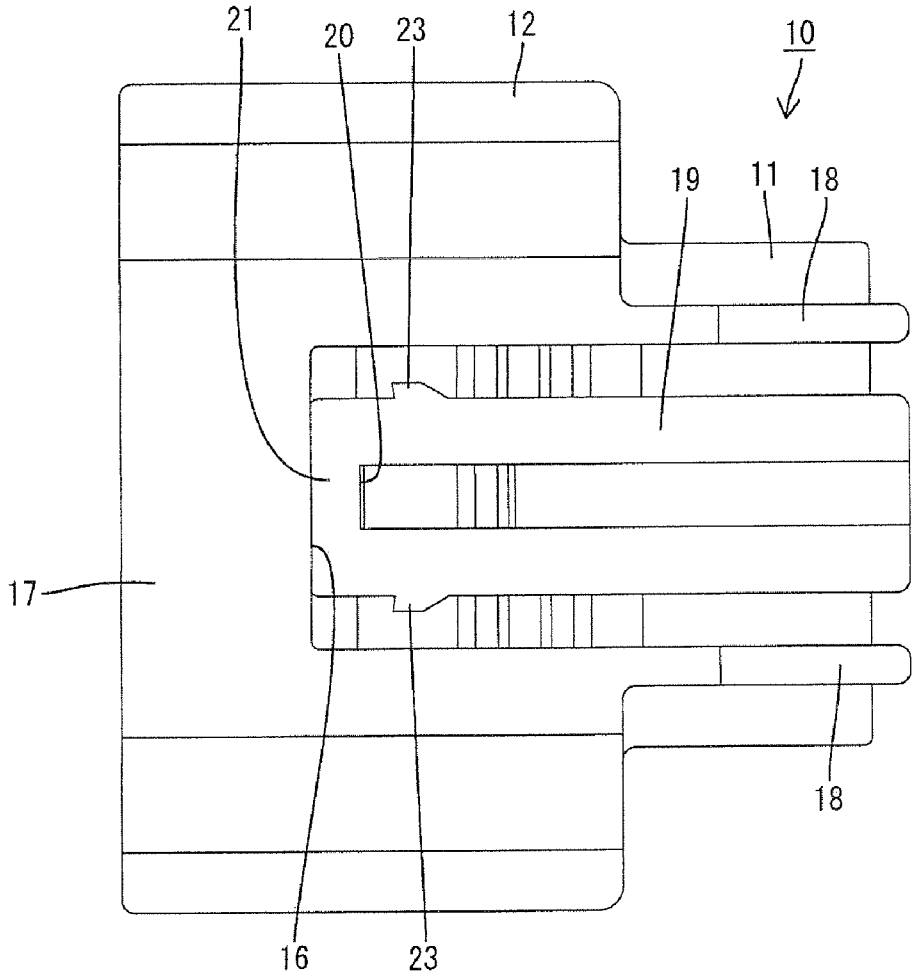
FIG. 4 is a plan view of the female housing.
Figure 5:
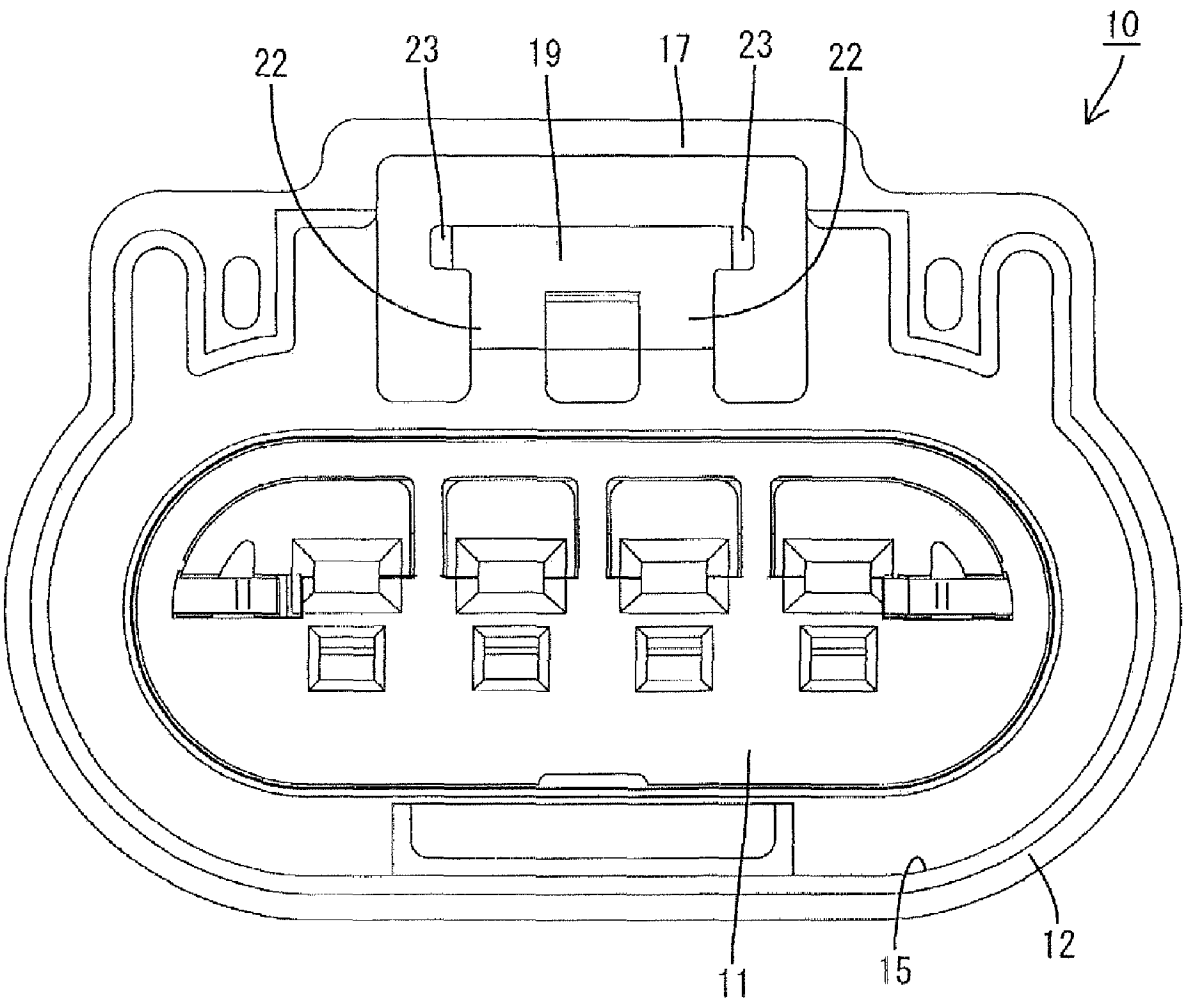
FIG. 5 is a front elevational view of the female housing.
Figure 6:
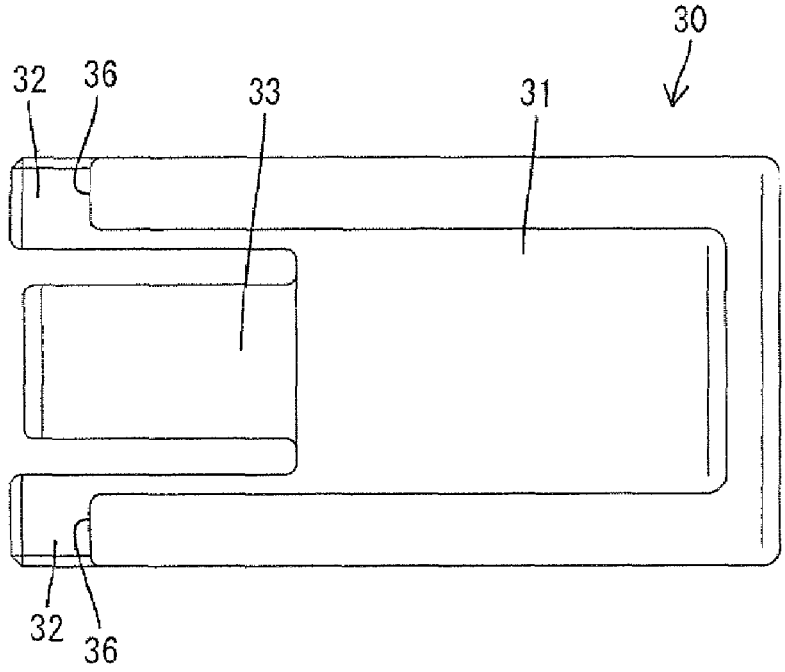
FIG. 6 is a plan view of the connection detector.
Figure 7:
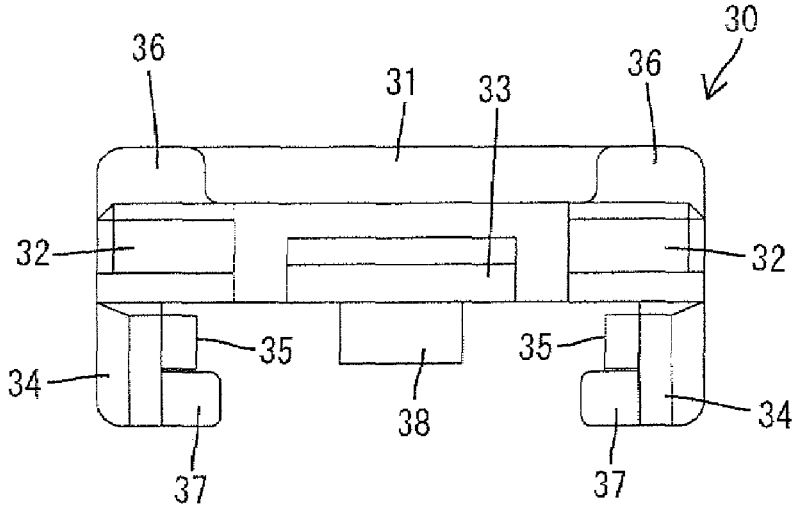
FIG. 7 is a front view of the connection detector.
Figure 8:
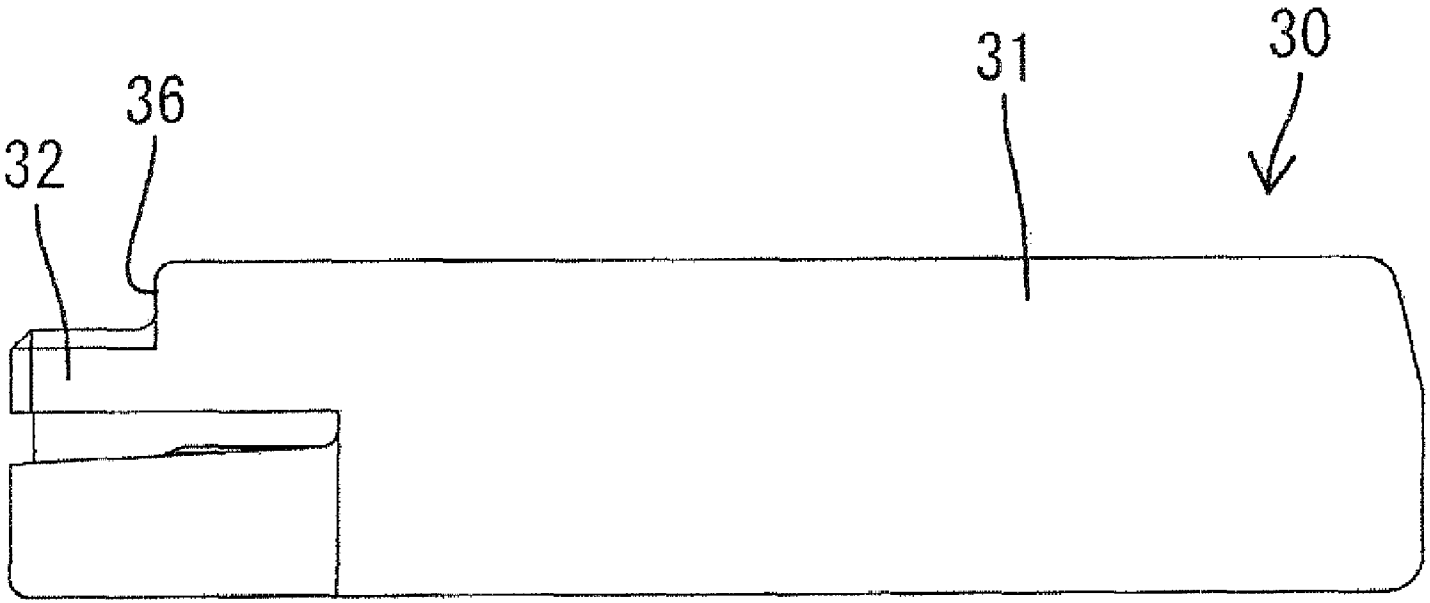
FIG. 8 is a side view of the connection detector.
Figure 9:
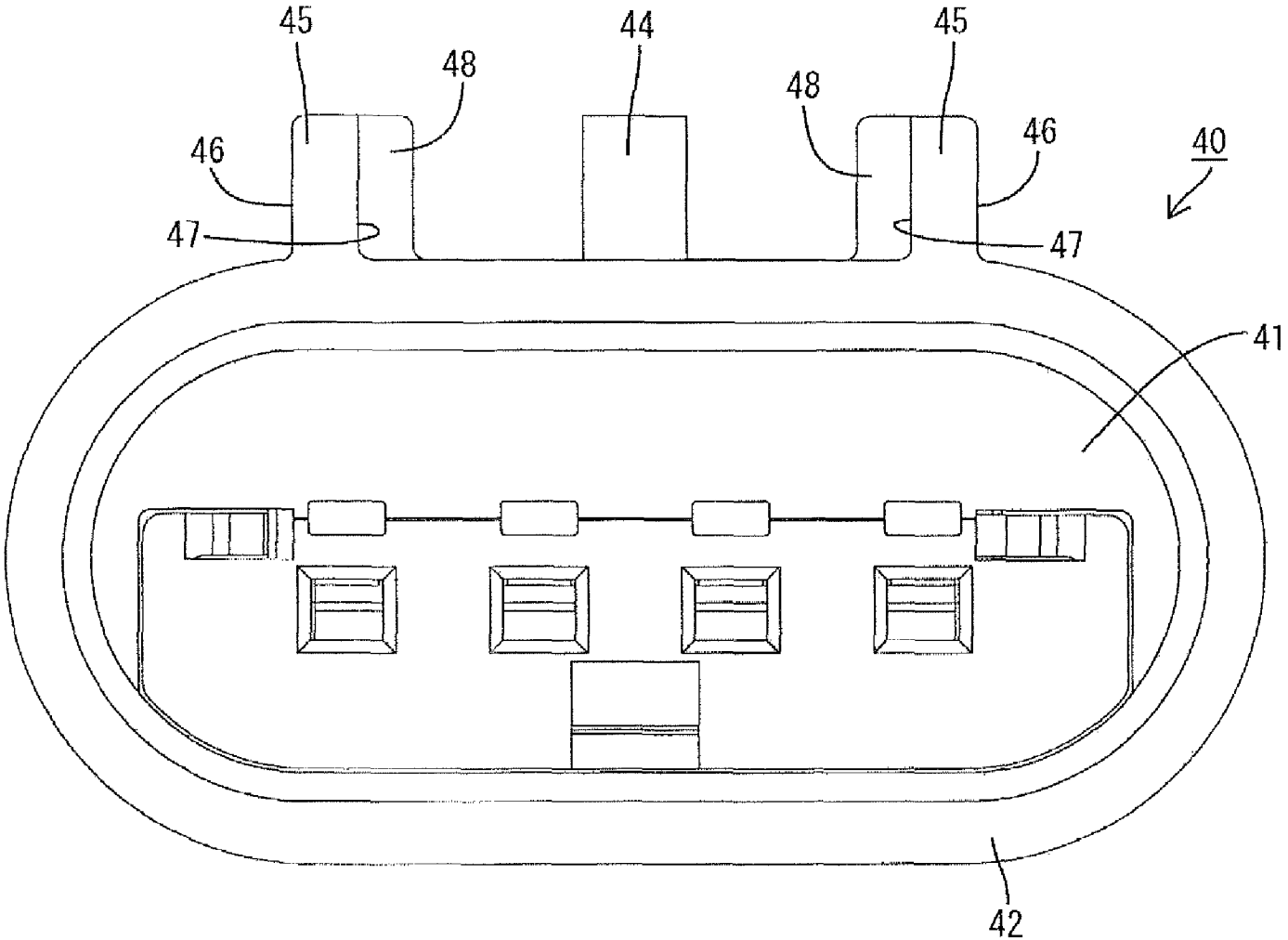
FIG. 9 is a front view of the male housing.
Figure 10:
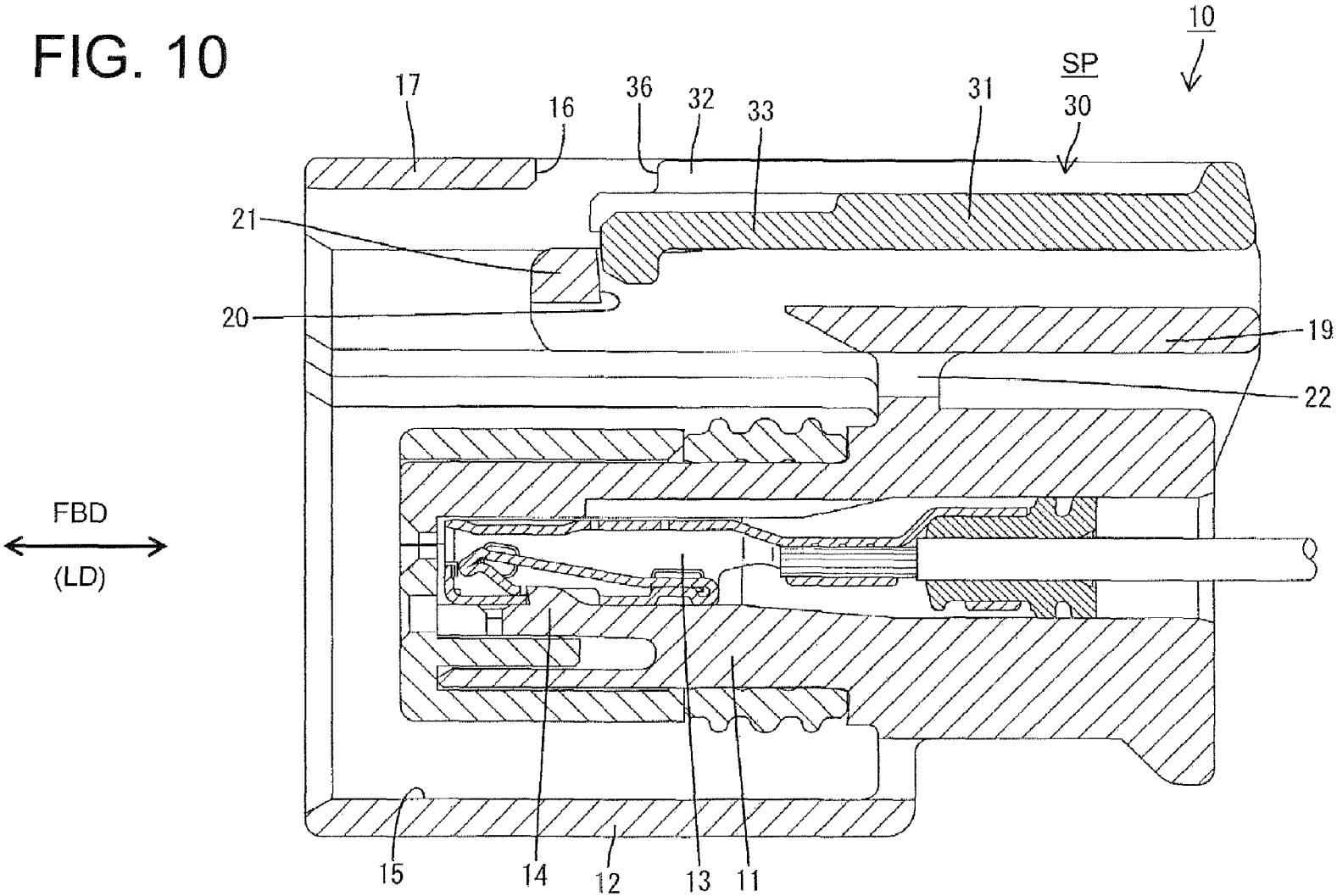
FIG. 10 is a longitudinal section of the female housing.
Figure 11:
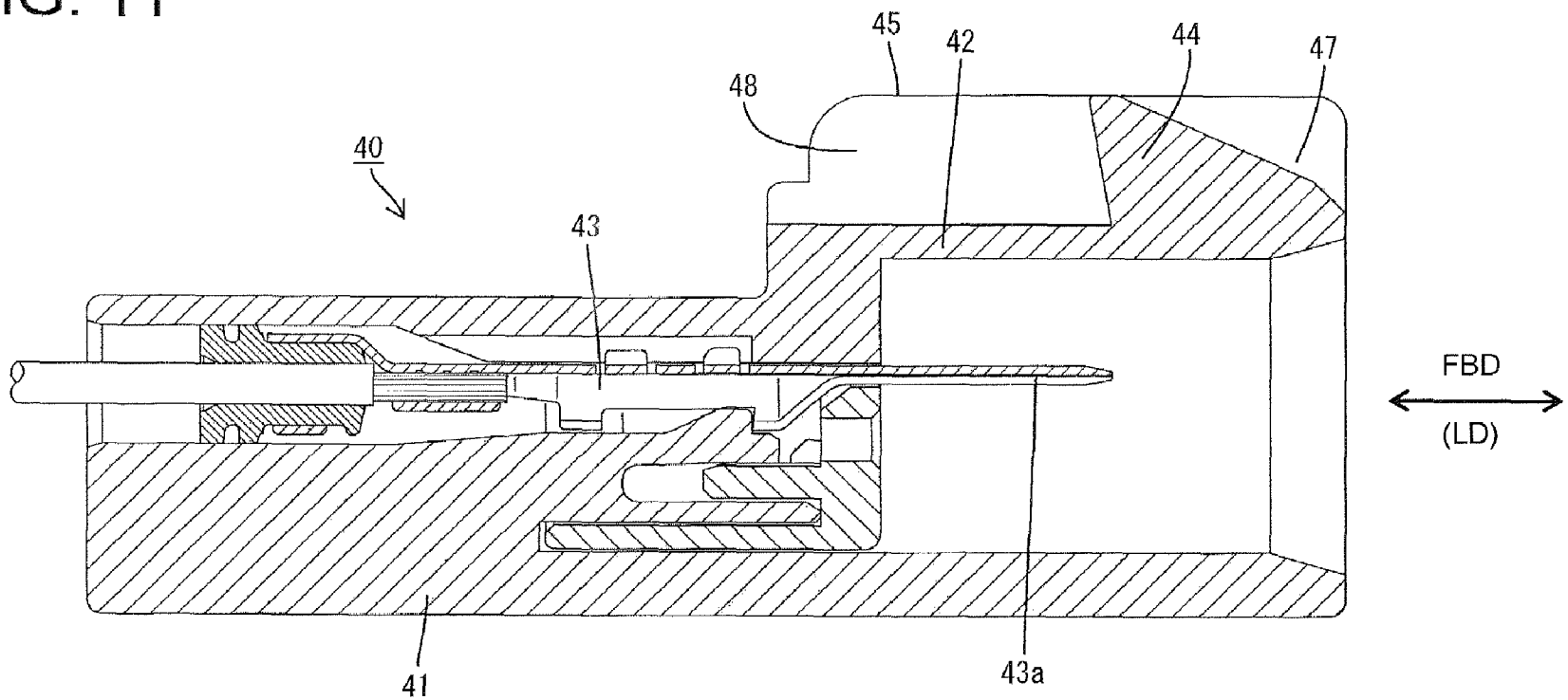
FIG. 11 is a longitudinal section of the female housing.

The front end of the connection detector 30 is behind the receiving portions 48 and the pressing portions 32 are spaced from the receiving surfaces 47 when the connection detector 30 is at the standby position SP on the properly connected housings 10, 40, as shown in FIG. 2. The connection detector 30 then is moved forward towards the detection position DP. Outer edges of the front ends of the pressing portions 32 contact the receiving portions 48 of the receiving surfaces 47 immediately before the connection detector 30 reaches the detection position DP. Additional pushing forces move the connection detector 30 forward so that the pressing portions 32 slide and strongly pressing the receiving portions 48 to bite therein. Both the receiving portions 48 and the pressing portions 32 have high rigidity and are difficult to deform resiliently deform. Accordingly, the receiving portions 48 and the pressing portions 32 deform plastically. This pressing state of the pressing portion 32 against the receiving portions 48 is kept until the connection detector 30 reaches the detection position.

Frictional resistance and the biting action between the pressing portions 32 and the receiving portions 48 while the connection detector 30 is at the detection position DP prevents the connection detector 30 from making relative backlash movements in forward and backward directions FBD, vertical directions and lateral directions with respect to the male connector housing 40. Relative backlash movements between the female and male housings 10 and 40 also are prevented in vertical and lateral directions. This prevention of relative backlash movements prevents fine sliding abrasion of the electrically connected female and male terminal fittings 13 and 43.

As described above, the connection detector 30 does not contact the receiving portions 48 when the connection detector 30 is at the standby position SP. However, the pressing portions 32 of the connection detector 30 press against the receiving portions 48 of the male housing 40 to produce large frictional resistance when the connection detector 30 is at the detection position DP. Thus, the connection detector 30 cannot move with respect to the male housing 40 in vertical and lateral directions intersecting the connecting direction CD of the two connector housings 10, 40. Additionally, connection resistance caused by pressing the pressing portions 32 against the receiving portions 48 during the connection process is prevented by holding the connection detector 30 at the standby position SP. Therefore, the connecting operation of the two connector housings 10, 40 can be performed easily and smoothly.

The guide ribs 45 of the male housing 40 are substantially parallel with the connecting direction CD and slide in contact with the female housing 10. Additionally, the receiving portions 48 are provided on the receiving surfaces 47, which are different from sliding contact surfaces 46 of the guide ribs 45 with the female housing 10. The guide ribs also function as the receiving portions 48, and the shape of the male housing 40 is simplified as compared to the case where receiving portions are formed separate from the guide ribs.

The guide ribs 45 are widened gradually in the moving direction of the connection detector 30 from the standby position SP towards the detection position DP to form the inclined receiving portions 48. Thus, pressing forces of the pressing portions 32 against the receiving portions 48 increase to strengthen the biting action as the connection detector 30 approaches the detection position DP, and movements of the connection detector 30 relative to the male housing 40 are prevented more reliably.

The prior art guide ribs of the housing have inner surfaces that are substantially parallel to the outer surfaces, and hence the prior art guide ribs are of substantially constant width over their entire length. The gradually widened guide ribs 45 of the invention have slanted receiving surfaces 47 that can be formed merely by obliquely cutting the inner surfaces of cavities in a mold (not shown) for molding the male housing 40. As described above, there is no need to fabricate a new mold for changing the shapes of the guide ribs, therefore the mold cost can be reduced.

Figure 14:
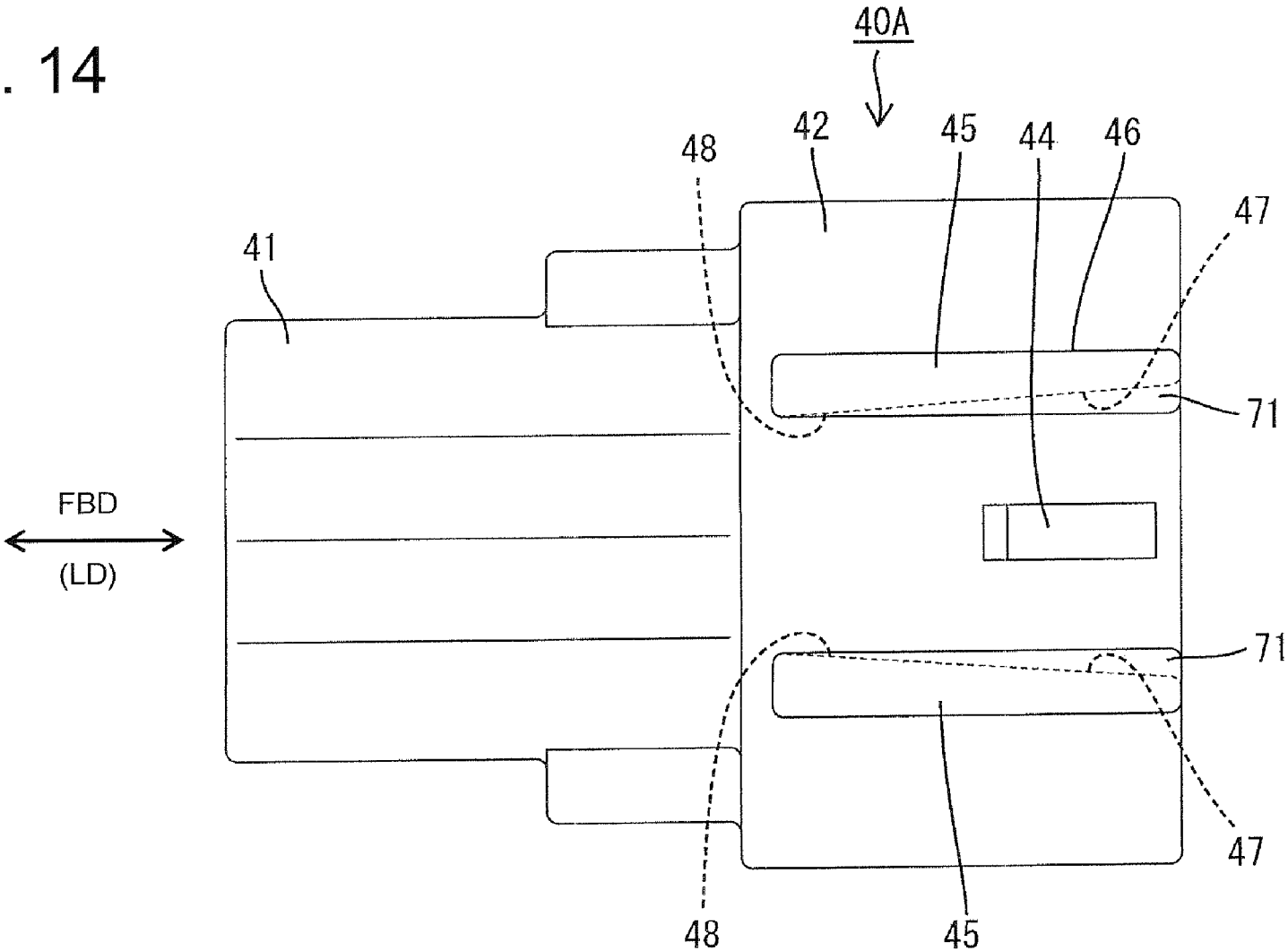
FIG. 14 is a plan view of a male housing of a second embodiment.
Figure 15:
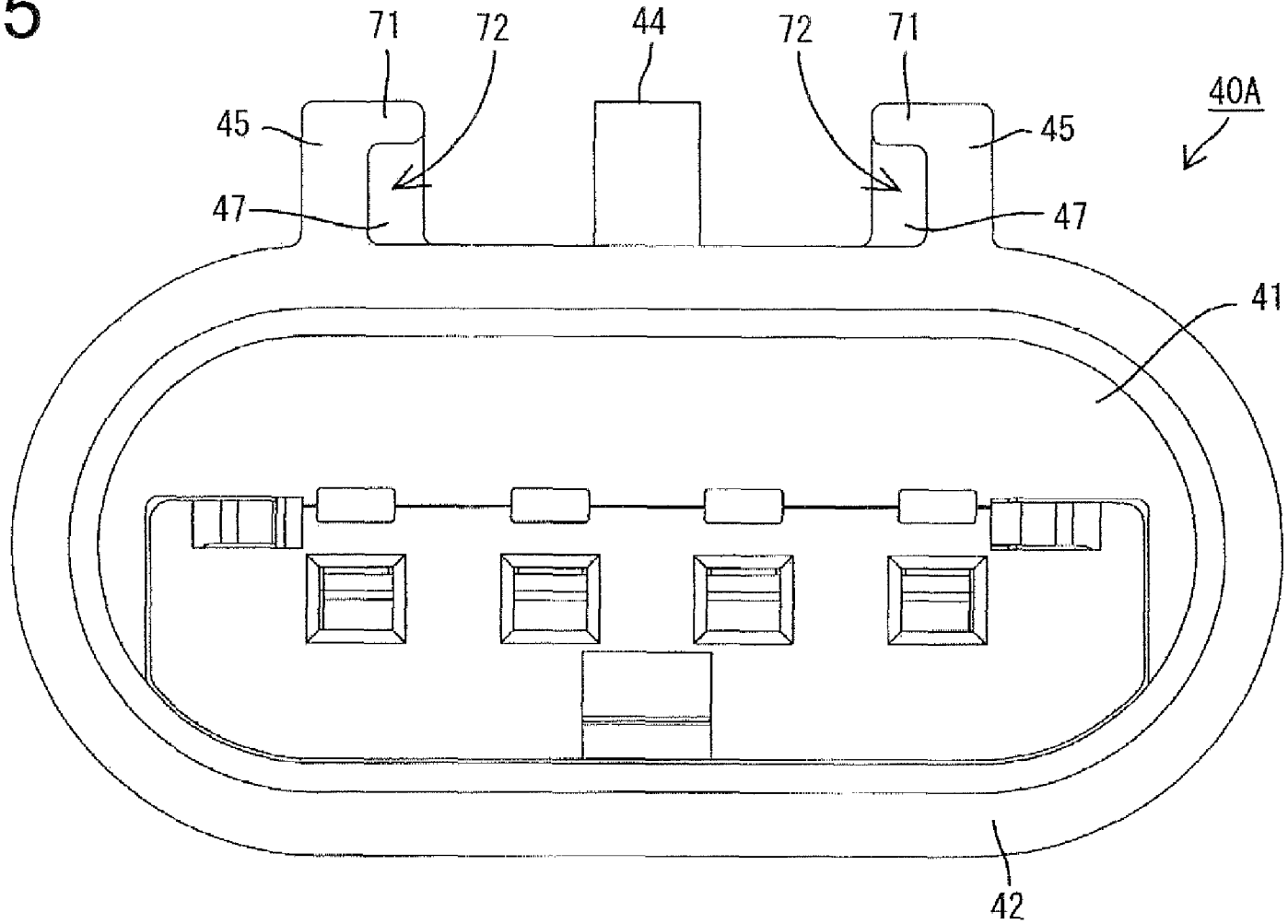
FIG. 15 is a front view of the male housing.

A second embodiment of the invention is illustrated in FIGS. 14 and 15. In the second embodiment, left and right eaves 71 project in from the tops of the guide ribs 45 of a male housing 40A. Each eave 71 is arranged at substantially right angles to the corresponding receiving surface 47 of the guide rib 45, and a projecting distance thereof is reduced gradually from the front end to the rear end of the guide rib 45. When viewed from above, the guide ribs 45 with the eaves 71 extend with the substantially same width in forward and backward directions FBD, and the projecting distances of the eaves 71 are substantially zero at the rear ends of the guide ribs 45.

A spacing between the lower surfaces of the eaves 71 and the upper surface of the receptacle 42 is substantially constant in forward and backward directions FBD and is substantially equal to a distance between upper and lower surfaces of the pressing portions 32 of the connection detector 30 (thickness). Mount spaces 72 for the connection detector 30 are defined by the eaves 71, the guide ribs 45 and the receptacle 42 for receiving the pressing portions 32 and preventing loose movements thereof.

According to the second embodiment, the pressing portions 32 enter the mount spaces 72 below the eaves 71 as the two housings 10, 40A are connected. Thus, the connection detector 30 reliably is prevented from making outward movements with respect to the male housing 40A and, consequently, vertical backlash of the two housings 10, 40A is hindered reliably.

The invention is not limited to the above described and illustrated embodiments. For example, the following embodiments are also embraced by the technical scope of the present invention as defined by the claims.

The connection detector may be mounted to the outer peripheral surface of the receptacle of the male housing, and the receiving portions may be on the inner peripheral surface of the tubular fitting of the female housing.

Backlash between the connection detector and the male housing in directions intersecting the connecting direction CD of the two housings may be prevented by at least partly sandwiching the receiving portions by the pair of pressing portions of the connection detector.

The connection detector may be formed so as not to be inclined together with the lock arm and may be provided without touching the lock arm.

The receiving portions may be provided separately from the guide ribs.

The connection detector may be formed to be insertable into the receptacle of the male housing. In this case, vertical backlash of the two housings may be prevented by wedging the connection detector at least partly between the outer surface of the terminal accommodating portion of the female housing and the inner surface of the receptacle.

What is claimed is:

1. A connector, comprising:

a first housing with a tubular fitting having first and second inner peripheral surfaces aligned substantially parallel to a connecting direction;

a second housing having a front end insertable into the tubular fitting along the connecting direction, first and second guide ribs formed on the second housing, first and second sliding contact surfaces facing outwardly on the respective first and second guide ribs and being aligned substantially parallel to the connecting direction, the first and second sliding contact surfaces being disposed for sliding contact respectively with the first and second inner peripheral surfaces of the tubular fitting, first and second receiving surfaces facing one another on the respective first and second guide ribs, the first and second receiving surfaces converging at locations farther from the front end of the second housing; and a connection detector slidably mounted on the first housing for movement along the connecting direction between a standby position and a detection position, the connection detector being spaced from the receiving surfaces when the connection detector is at the standby position, and the connection detector having first and second pressing portions that press the receiving surfaces when the connection detector is at the detection position and when the first and second housings are connected to prevent transverse movements of the connection detector with respect to the second housing.

2. The connector of claim 1, wherein the guide rib on the second housing is arranged adjacent to a lock for locking the two housings together.

3. The connector of claim 1, wherein each of the guide ribs is widened gradually at farther distances from the front end of the second housing.

4. The connector of claims 3, wherein each of the guide ribs is formed with an eave aligned at an angle to the receiving surface and a mount space being defined adjacent the eave and the receiving surface for receiving the connection detector and preventing loose movements thereof.

* * * * *